US012480482B2

(12) United States Patent
Atkare et al.

(10) Patent No.: US 12,480,482 B2
(45) Date of Patent: Nov. 25, 2025

(54) BALANCED PUMP-AXIAL PISTON PUMP

(71) Applicant: Milwaukee Electric Tool Corporation, Brookfield, WI (US)

(72) Inventors: Deep Atkare, Brookfield, WI (US); James O. Myrhum, Jr., West Bend, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 18/409,456

(22) Filed: Jan. 10, 2024

(65) Prior Publication Data

US 2024/0229783 A1 Jul. 11, 2024

Related U.S. Application Data

(60) Provisional application No. 63/479,342, filed on Jan. 10, 2023.

(51) Int. Cl.
*F04B 9/04* (2006.01)
*F04B 1/128* (2020.01)

(52) U.S. Cl.
CPC ..... *F04B 9/042* (2013.01); *F04B 1/128* (2013.01)

(58) Field of Classification Search
CPC ..... F04B 9/042; F04B 1/128; F16H 25/12
USPC ..... 74/55, 56
See application file for complete search history.

(56) References Cited

U.S. PATENT DOCUMENTS

RE29,503 E * 12/1977 Varga ..... F04B 7/06 417/492
5,028,217 A * 7/1991 Miller ..... F16H 25/12 74/424.89
2009/0092508 A1* 4/2009 Isono ..... F04B 9/025 417/415
2019/0195208 A1 6/2019 Murakoshi et al.
2022/0349393 A1 11/2022 Myrhum, Jr.

* cited by examiner

*Primary Examiner* — Bryan M Lettman
(74) *Attorney, Agent, or Firm* — Quarles & Brady LLP

(57) ABSTRACT

A balanced pump-axial piston pump for a hydraulic tool. The balanced pump-axial piston pump includes a camshaft, cam followers, a lift block, a spring, a pump piston, a piston chamber, and a manifold. Rotation of the camshaft drives radial movement of the cam followers at the same time. The radial movement of the cam followers make the lift block move linearly along the axis of the hydraulic tool. The spring pushes the piston against the lift block so that the piston is kept in contact with the lift block. The linear movement of the lift block moves the piston linearly in the piston chamber, thereby pumping oil and providing hydraulic power.

20 Claims, 6 Drawing Sheets

BALANCED PUMP-AXIAL PISTON PUMP

RELATED APPLICATIONS

This application claims priority under 35 U.S.C. § 119 to U.S. Provisional Patent Application No. 63/479,342 filed on Jan. 10, 2023, the entire contents of which is incorporated herein by reference.

FIELD

The present disclosure relates generally to power tools. More particularly, the present disclosure relates to balanced pump-axial piston pump designs for a hydraulic power tool.

BACKGROUND

Hydraulic crimpers and cutters are different types of hydraulic power tools for performing work (e.g., crimping or cutting) on a workpiece. In such tools, a hydraulic pump can be utilized for pressurizing hydraulic fluid and transferring it to a cylinder in the tool. This cylinder causes an extendible piston to be displaced towards a cutting or crimping head. The piston exerts a force on the head of the power tool, which may typically include opposed jaws with certain cutting or crimping features, depending upon the particular configuration of the power tool. In this case, the force exerted by the piston may be used for closing the jaws to perform cutting or crimping on a workpiece (e.g., a wire) at a targeted location.

In some known hydraulic tools, a motor can drive the hydraulic pump by way of a gear reducer or other type of gear assembly. However, there are certain perceived disadvantages to such known hydraulic tools. For example, the motor, hydraulic pump (e.g., one or more pump pistons), and gear assembly can often be complex, heavy, and bulky, particularly in hydraulic tools that are designed for high force applications. In some cases, this can increase the cost to manufacture the hydraulic tool and might make the hydraulic tool more cumbersome for an operator to use.

Therefore, there is a desire to provide a less complex, more light weight hydraulic tool that can be used for high force applications or lower force applications and that is also perhaps more user friendly to the operator.

SUMMARY

Embodiments of the disclosure provide a balanced pump-axial piston pump for a hydraulic tool. The balanced pump-axial piston pump comprises a motor having a gearbox rotating a camshaft. The balanced pump-axial pump also comprises ball followers configured to move radially outwards when the camshaft rotates. The balanced pump-axial piston pump also comprises a lift block and a piston, wherein the piston moves linearly in a piston chamber pumping oil and providing hydraulic power. The balanced pump-axial piston pump also comprises a spring, wherein the spring pushes the piston. The balanced pump-axial piston pump also comprises a manifold holding together the camshaft, ball followers, lift block, piston and spring. In operation of the balanced pump-axial piston pump, rotation of the camshaft radially moves the ball followers outwards and makes the lift block move linearly along the axis of the tool touching the piston, thereby moving the piston linearly in the piston chamber pumping the oil and providing hydraulic power.

Some embodiments of the disclosure provide a pump assembly for a hydraulic tool. The pump assembly can include a manifold, a camshaft, a lift block, and cam followers. The camshaft can extend axially into the manifold and can be arranged to receive a rotational input at a shaft portion of the camshaft. The lift block can at least partially surround the camshaft in a radial direction. The lift block can be movable in an axial direction relative to the manifold. The cam followers can be arranged to move radially with respect to the camshaft and can engage the lift block at an internal surface of the lift block.

Some embodiments of the disclosure provide a reciprocating assembly for a balanced pump-axial piston pump. The reciprocating assembly can include a lift block, a camshaft, and one or more cam followers. The lift block can include an internal chamber that varies in diameter along an axial direction to define an internal cam surface. The lift block can be arranged to move between an extended position and a retracted position in the axial direction. The camshaft can extend into the internal chamber of the lift block and include an external cam surface. The camshaft can be arranged to receive a rotational input. The one or more cam followers can be disposed, in a radial direction, between the internal cam surface of the lift block and the external cam surface of the camshaft. The one or more cam followers can be arranged to only move radially with respect to the camshaft. That is, the cam followers may not move axially with respect to the camshaft.

Some embodiments of the disclosure provide a method for providing axial pump action with a pump assembly housed within a manifold. The method can include providing rotational input to a camshaft having an external cam surface. The method can further include radially translating one or more cam followers relative to the camshaft by moving, relatively, the one or more cam followers along the external cam surface of the camshaft. The method can further include axially translating a lift block to provide axial pump action by moving, relatively, the one or more cam followers along an internal cam surface of the lift block, the internal cam surface formed by an internal chamber of the lift block that varies in internal diameter in an axial direction.

BRIEF DESCRIPTION OF THE DRAWINGS

The accompanying drawings, which are incorporated in and form a part of this specification, illustrate embodiments of the disclosure and, together with the description, serve to explain the principles of embodiments of the disclosure.

DETAILED DESCRIPTION

Disclosed embodiments will now be described more fully hereinafter with reference to the accompanying drawings, in which some, but not all of the disclosed embodiments are shown. Indeed, several different embodiments may be provided and should not be construed as limited to the embodiments set forth herein. Rather, these embodiments are provided so that this disclosure will be thorough and complete and will fully convey the scope of the disclosure to those skilled in the art.

The disclosed balanced pump-axial piston pump will be described with respect to an example hydraulic tool. However, it should be understood that any one or more example embodiments of the disclosed balanced pump-axial piston pump could be incorporated in alternate forms of tools and other pump applications. Furthermore, it should be understood that one or more example embodiments of the disclosed balanced pump-axial piston pump could be used outside of the context of a pump system, and could more generally be used as a mechanism that generates reciprocation.

Figure 1:
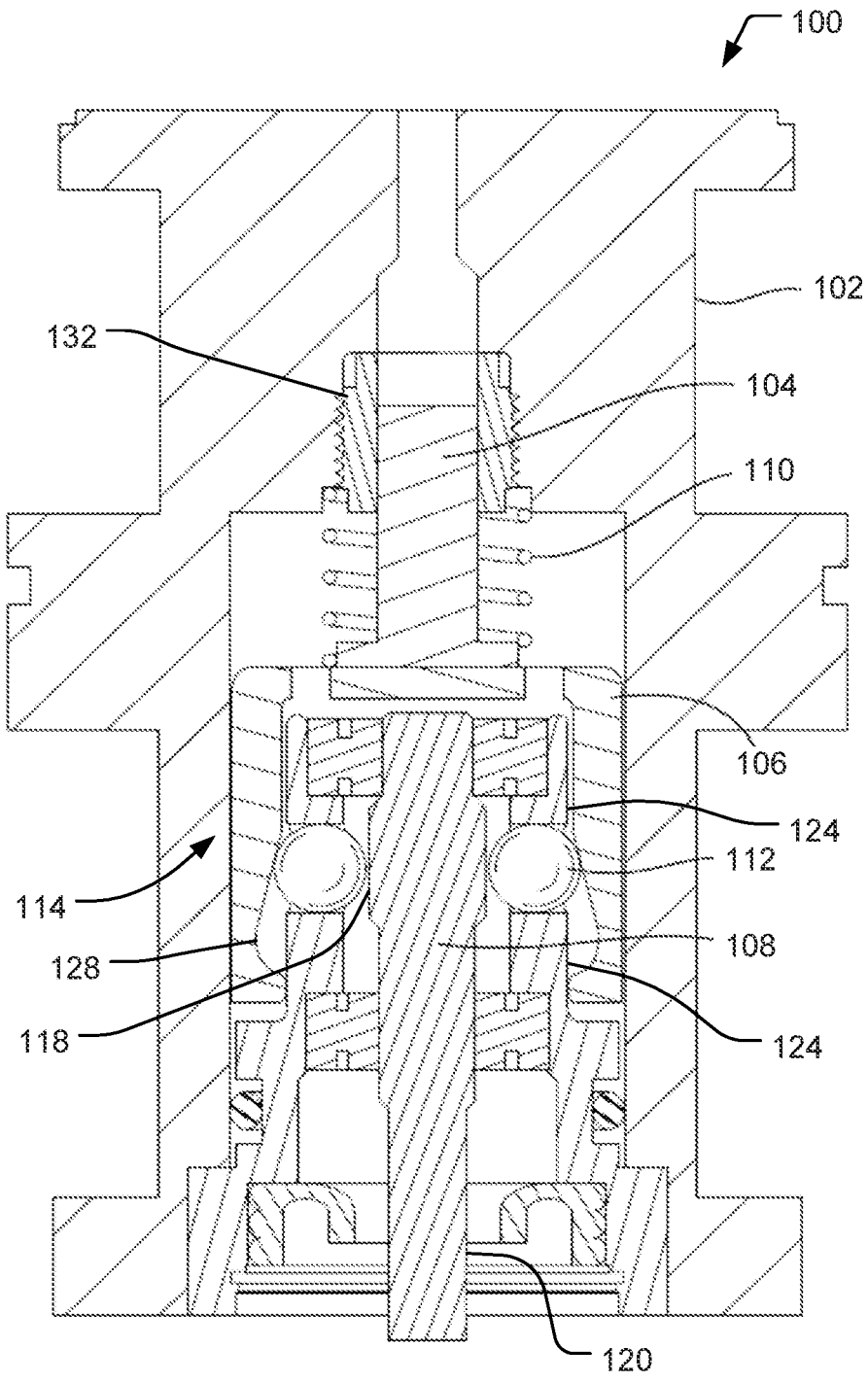
FIG. 1 is a cross-sectional view of a balanced pump-axial piston pump assembly with a piston in a first position according to an embodiment of the disclosure.
Figure 2:
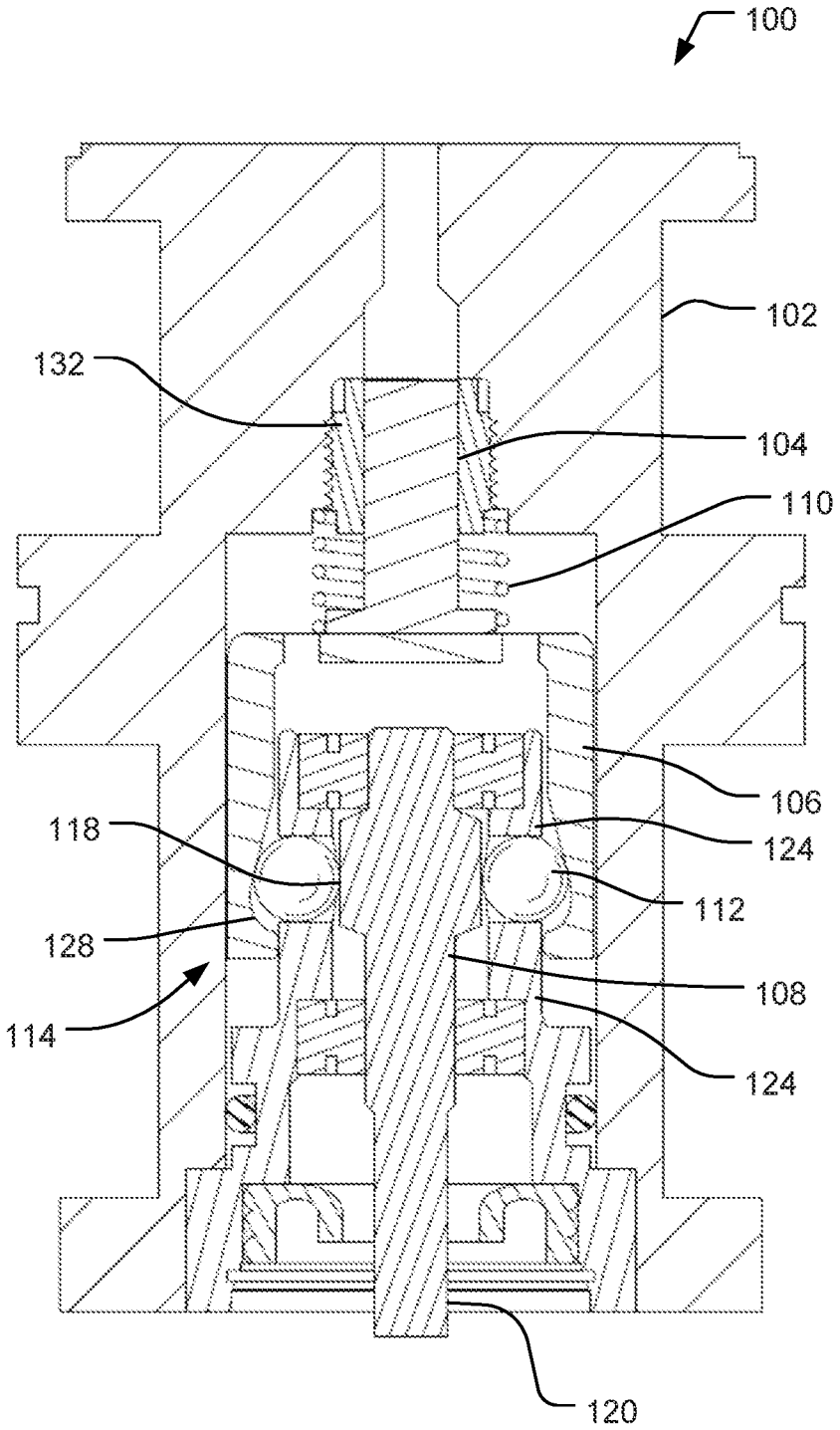
FIG. 2 is a cross-sectional view of the balanced pump-axial piston pump assembly of FIG. 1 in a second position.

FIGS. 1 and 2 illustrate a balanced pump-axial piston pump assembly 100 for a hydraulic tool. The pump assembly 100 includes a manifold 102 that houses a piston 104, a lift block 106, and a camshaft 108. The lift block 106 can be in mechanical communication with the piston 104 via a biasing member. In the illustrated embodiment, the biasing member is configured as a spring 110. The spring 110 of FIGS. 1 and 2 is a helical spring, however, other configurations are possible. For example, the embodiment of FIG. 3 includes a conical spring 210. In other embodiments, other spring arrangements are possible, such as Belleville or disc springs.

The pump assembly further 100 includes cam followers 112. In the illustrated embodiment, the cam followers 112 are configured as balls. However, other geometries are possible (see, for example, FIG. 6). In general, the cam followers 112 are arranged to be moved (radially) by a cam surface 118 of the camshaft 108. The camshaft 108 can be coupled to (directly or indirectly) a motor to provide rotational input to a shaft portion 120 of the camshaft 108. In some embodiments, the camshaft 108 may be directly coupled to a motor. However, in other embodiments, the camshaft 108 may be in communication with a gear box or gear train so that the camshaft 108 is indirectly mechanically coupled to a motor.

The cam followers 112, the lift block 106, and the camshaft 108 can form a reciprocating assembly 114. Within the reciprocating assembly 114, the cam followers 112 are positioned radially between the cam surface 118 of the camshaft 108 and the lift block 106. In the axial direction, the cam followers 112 can be arranged between cam guides 124. During reciprocating action of the lift block 106, each of the cam followers 112 and the cam guides 124 may remain in the same axial position (e.g., relative to the manifold 102).

The lift block 106 can further include holes 126 or otherwise openings that extend between the internal chamber of the lift block 106 and an external surface of the lift block 106. The holes 126 may be utilized in embodiments where the entire pump assembly 100 is submerged in fluid (e.g., in oil). In such embodiments, during the pumping process when the camshaft 108 rotates and the lift block 106 oscillates axially, oil within the assembly can exert pressure on the lift block 106 in a direction that may reduce efficiency. The holes 126, however, can advantageously prevent or reduce fluid pressure buildup against the lift block 106 and permit fluid flow between the internal chamber an external surface of the lift block.

In use, the camshaft 108 can be rotated via rotational input to rotate the cam surface 118. As the cam surface 118 rotates, it can cyclically urge the cam followers 112 in a radial direction. As the cam followers 112 are urged radially outward, they can move along an internal surface 128 of the lift block 106. In the illustrated embodiment, the internal surface 128 of the lift block 106 can provide a secondary cam surface and can include a rounded profile (e.g., a curved geometry) that is wider in the radial direction towards the bottom (with respect to the orientation of FIGS. 1 and 2) in the axial direction of the lift block 106. As the cam followers 112 travel along the curved profile of the internal surface 128 of the lift block 106, the lift block is moved in the axial direction. Thus, rotational input to the camshaft 108 causes reciprocating axial movement of the lift block 106.

As the lift block 106 moves in the axial direction, so does the piston 104 within a piston chamber 132. This piston 104 is thereby arranged to pump hydraulic fluid. In general, the spring 110, seated between the lift block 106 and the piston 104, can push against the piston 104 and the top of the lift block 106 so that the spring stays in constant contact with the piston 104 and the lift block 106. In FIG. 1, the piston 104 is in a retracted position (axially) within the piston chamber 132 and the cam followers 112 are in a retracted position (radially) within the lift block 106. In FIG. 2, the piston 104 is in an extended position (axially) within the piston chamber 132 and the cam followers 112 are in an extended position (radially) within the lift block 106.

In FIG. 1, it is shown that the cam followers 112 are not in contact with the cam surface 118 of the camshaft 108, which can overall correspond to a retracted position of the pump assembly 100. However, in other embodiments, the cam surface 118 of the camshaft 108 may be dimensioned so that the cam surface 118 is in constant contact with the cam followers 112. In FIG. 2, the cam surface 118 is in contact with the cam followers 112. FIG. 2 can correspond to an extended position of the pump assembly 100. In general, the cam surface 118 of the camshaft 108 can define a non-circular cross-sectional profile so that different angular rotations of the camshaft 108 correspond to different radial positions of the cam followers 112. In some embodiments, the cam surface 118 of the camshaft 108 can define an oval-like cross-sectional profile.

In the illustrated embodiments, the pump assembly 100 is shown with a pair of cam followers 112. However, other quantities of cam followers 112 are possible. For example, in some embodiments, a pump assembly can include three cam followers which can provide three cycles of linear reciprocating movement per single rotation of the camshaft. As another example, some embodiments of a pump assembly can include four cam followers. Four cam followers can provide four cycles of linear reciprocation per single rotation of the camshaft.

In other embodiments, the lift block 106 can be arranged as a piston within the pump assembly 100, thereby eliminating the piston 104 and further reducing the size (e.g., in the axial direction) of the pump assembly 100. Still in other embodiments, there can be multiple pistons in mechanical communication with the lift block 106. In general, multiple pistons can increase flow output of the pump 100 without increasing the size of the reciprocating assembly 114.

In general, the axial assembly of the pump assembly 100 provides a reduced diameter pump compared to conventional pumps. This can be advantageous for use in hand-held hydraulic tools to reduce the overall diameter of the tool and provide an ergonomic grip for the user around a handle of the tool. The profile of the internal surface 128 of the lift block 106 can provide narrow, yet sufficient radial space for the cam followers to travel and translate the radial movement of the cam followers 112 into axial movement of the lift block 106. That is, embodiments of the disclosure can provide a pump assembly with a smaller camshaft with smaller cam displacement that achieves higher displacement of the lift block resulting in a higher piston stroke, compared to conventional pumps.

Thus, the geometry of the lift block 106 can provide desired reciprocating axial movement of a piston while requiring improved (e.g., less) radial movement compared to conventional pumps. Additionally, the axial assembly of the pump assembly 100 can provide reduced side loading exerted on the piston 104. In general, reduced side loading can reduce piston rub on the side walls of a mating part (e.g., the piston chamber 132), which can improve the length of the life of the piston compared to conventional piston pumps.

Figure 3:
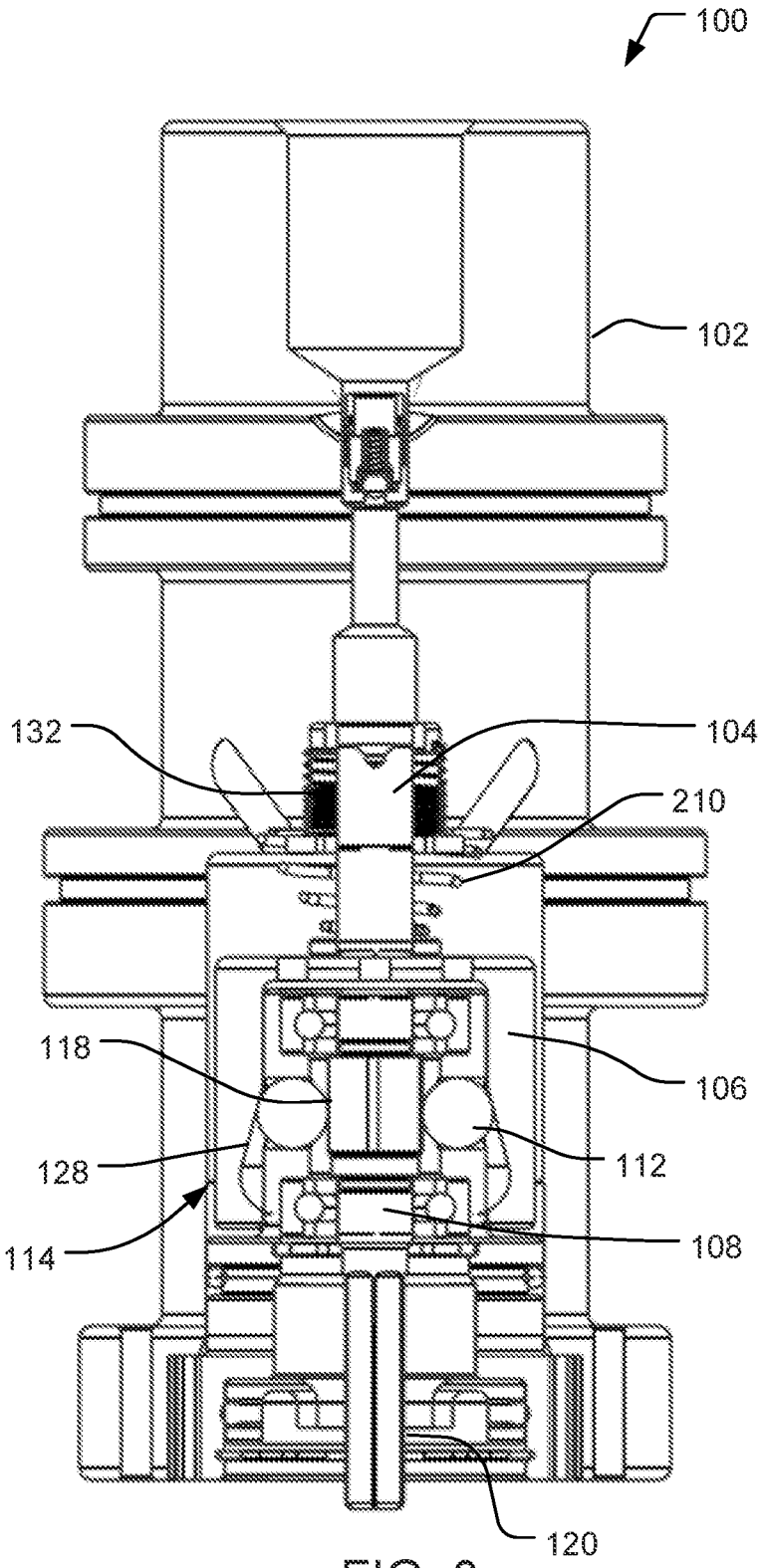
FIG. 3 is a cross-sectional view of a balanced pump-axial piston pump assembly including a conical spring according to an embodiment of the disclosure.

FIG. 3 illustrates the pump assembly 100 equipped with a conical spring 210. In general, a conical spring can completely collapse, or otherwise condense in an axial direction more than a cylindrical coil spring. For example, the conical spring 210 can collapse from a cone geometry to a disc geometry. Conical springs generally have non-linearly increasing spring rates during compression (i.e., the larger diameter coils are weaker and compress before the smaller, stronger coils.). Therefore, conical springs can allow for a reduced solid height as the smaller coils fit partially or fully within the larger coils. Thus, the conical spring 210 shown in FIG. 3 can be used to reduce the axial height of the pump assembly 100.

Figure 4:
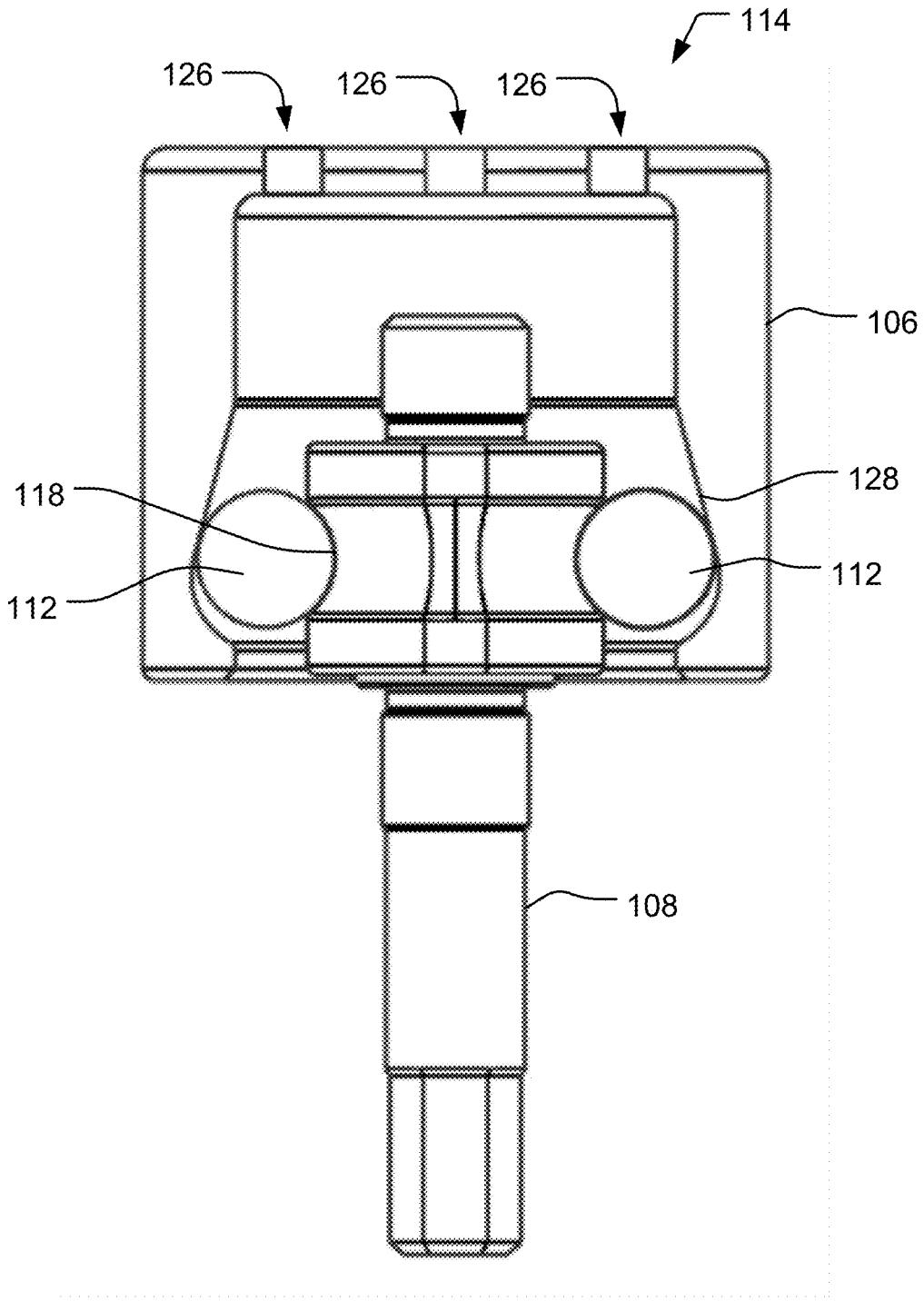
FIG. 4 is a cross-sectional view of a reciprocating assembly for a balanced pump-axial piston pump, the reciprocating assembly including a lift block having a rounded internal profile according to an embodiment of the disclosure.
Figure 5:
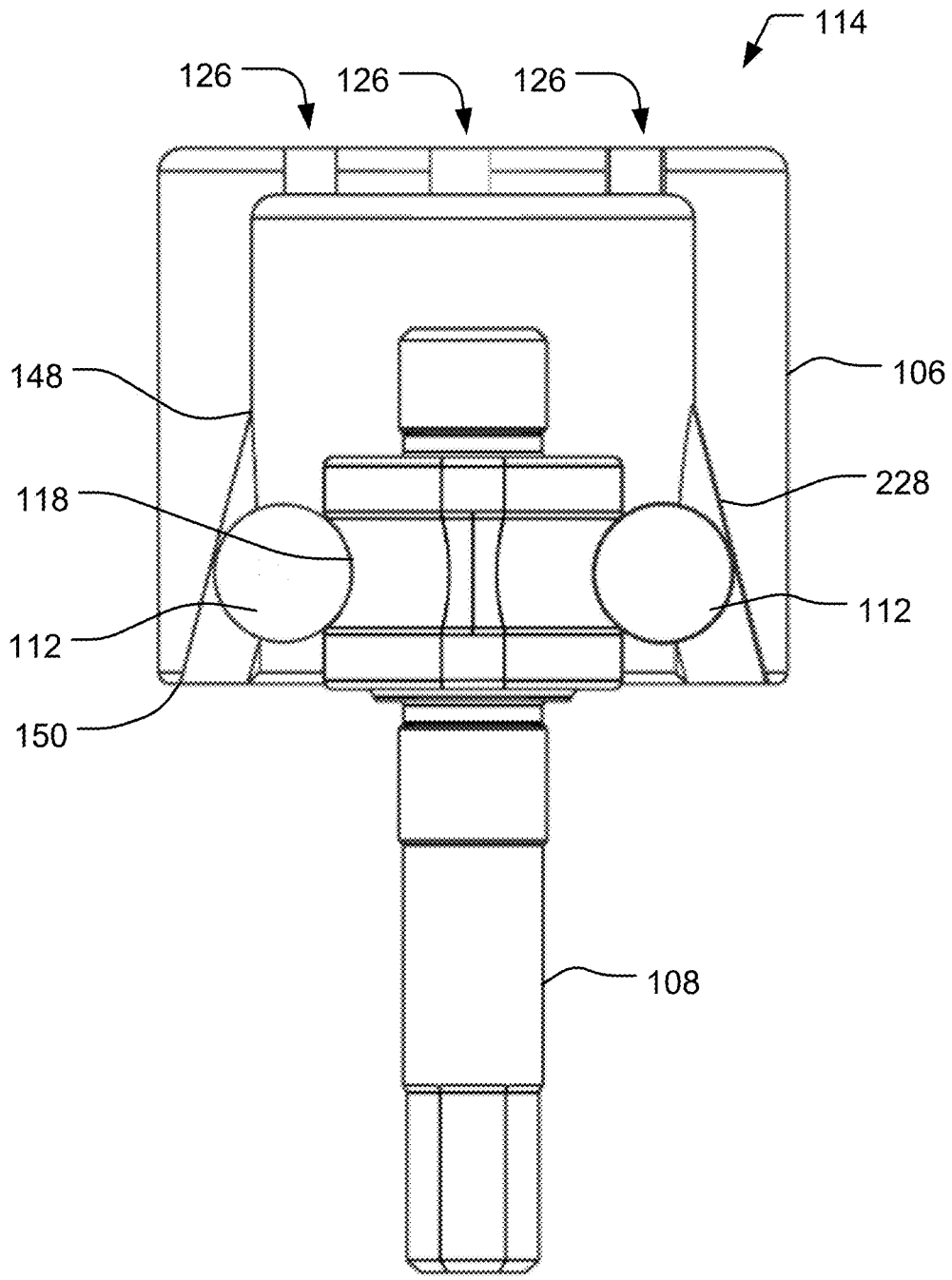
FIG. 5 is a cross-sectional view of a reciprocating assembly for a balanced pump-axial piston pump, the reciprocating assembly including a lift block having an angled internal profiled according to an embodiment of the disclosure.

FIGS. 4 and 5 illustrate additional embodiments of the reciprocating assembly 114. In FIGS. 4 and 5, the cam surface 118 of the camshaft 108 can include a concave profile in the radial direction. In general, this can facilitate manufacturing and assembly processes. For example, the concave profile of the cam surface 118 can provide a self-centering or self-locating relationship between the camshaft 108 and the cam followers 112 as the rounded sides of the cam followers 112 are inclined to be received within the indentation.

FIG. 5 illustrates an embodiment of the lift block 106 having a tapered internal surface 228. In general, the lift block 106 defines a cylindrical geometry. The internal bore of the lift block 106 of FIG. 5 also defines a semi-cylindrical geometry. However, the internal bore includes a medial diameter 148 at a medial section that increases linearly to a distal diameter 150 at a distal section to form the tapered internal surface 228. In general, the geometry of the lift block 106 of FIG. 5 can simplify manufacturing by reducing or removing complex curves or other surfaces that can be difficult or time consuming to machine or otherwise manufacture. Furthermore, the tapered internal surface 228 of the lift block 106 of FIG. 5 can simplify assembly by reducing corners or edges that the cam followers 112 may have to be snapped or otherwise maneuvered past.

Figure 6:
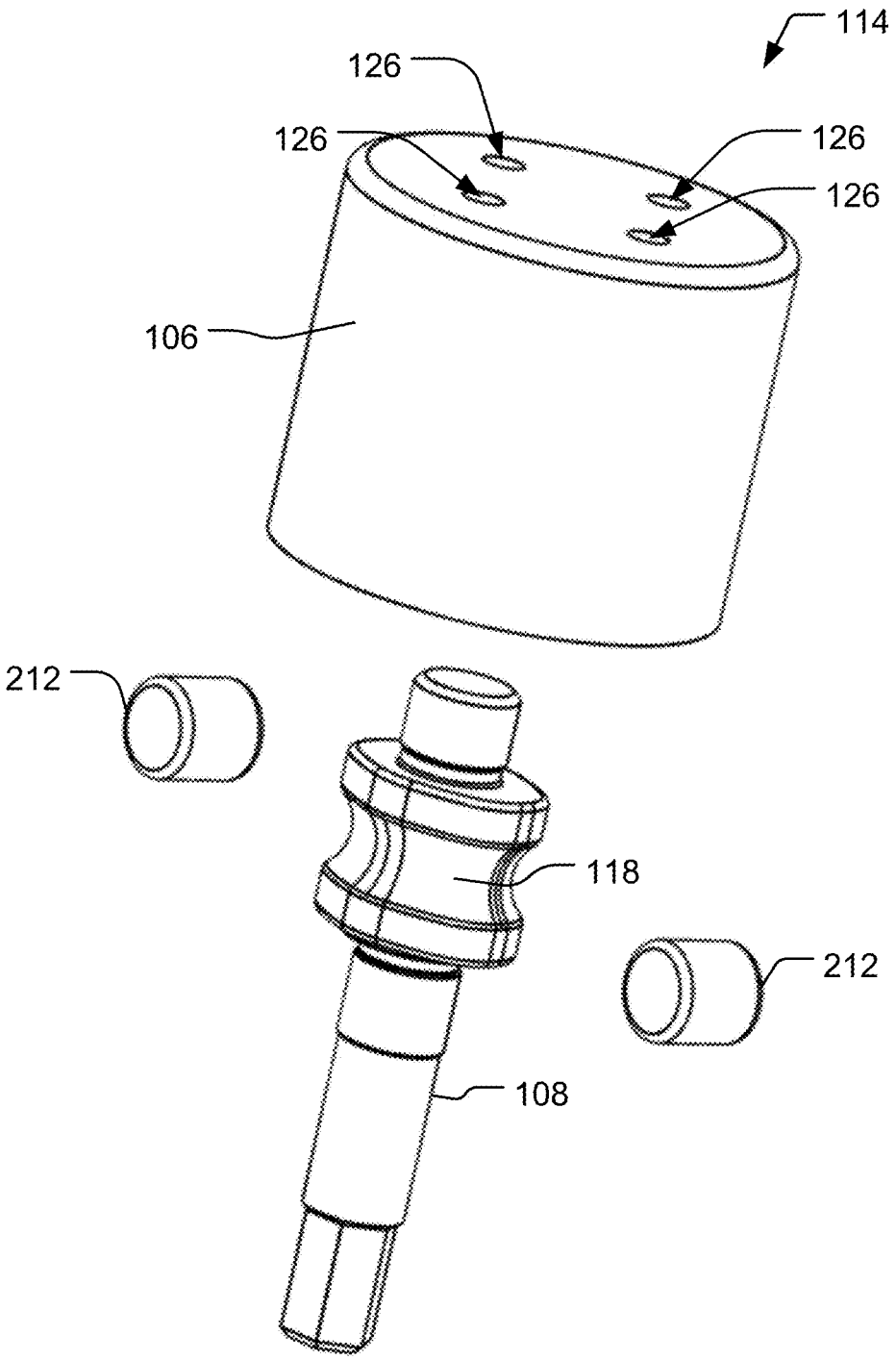
FIG. 6 is an exploded isometric view of a reciprocating assembly for a balanced pump-axial piston pump, the reciprocating assembly including cylindrical cam followers according to an embodiment of the disclosure.

FIG. 6 illustrates another configuration of the reciprocating assembly 114. In the embodiment shown in FIG. 6, the cam followers 212 are configured as cylinders. The use of cylindrical cam followers 212 can reduce the loading and stress on the cam followers compared to other geometries, such as spheres.

As described above, embodiments of the balanced pump-axial piston pump can provide a smaller pump assembly compared to conventional pumps. It should also be appreciated that the embodiments of the pump assembly and reciprocating assembly shown in FIGS. 1-6 may be by way of example and can include other arrangements not necessarily shown in a single embodiment (e.g., substitution or combination of any number of components from two or more embodiments).

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

The invention claimed is:

1. A pump assembly for a hydraulic tool, the pump assembly comprising:

a manifold;

a camshaft including a shaft portion, the camshaft extending axially into the manifold and receiving a rotational input at the shaft portion;

a lift block that at least partially surrounds the camshaft in a radial direction, the lift block movable in an axial direction relative to the manifold; and cam followers arranged to move radially with respect to the camshaft and engage the lift block at an internal surface of the lift block.

2. The pump assembly of claim 1, further comprising a piston coupled to the lift block, the piston movable within a piston chamber and arranged to pump hydraulic fluid.

3. The pump assembly of claim 2, further comprising a spring seated between the lift block and the piston.

4. The pump assembly of claim 3, wherein the spring is a conical spring compressible from a cone geometry to a disc geometry.

5. The pump assembly of claim 1, wherein the internal surface of the lift block is a secondary cam surface having a curved geometry that varies in diameter in the axial direction.

6. The pump assembly of claim 1, wherein the internal surface of the lift block is a secondary cam surface having a tapered geometry that increases in diameter from a medial section to a distal section, the camshaft extending into the lift block at the distal section.

7. The pump assembly of claim 1, wherein the cam followers include a first cam follower and a second cam follower.

8. The pump assembly of claim 1, wherein the cam followers are cylinders.

9. The pump assembly of claim 1, further comprising a cam guide arranged to prevent axial movement of the cam followers relative to the manifold.

10. The pump assembly of claim 1, further comprising a cam surface including a concave profile in a radial direction.

11. The pump assembly of claim 1, wherein the lift block includes one or more holes arranged to permit fluid flow between an internal chamber of the lift block and an external surface of the lift block.

12. A reciprocating assembly for a balanced pump-axial piston pump, the reciprocating assembly comprising:

a lift block that includes an internal chamber that varies in diameter along an axial direction to define an internal cam surface, the lift block arranged to move between an extended position and a retracted position in the axial direction;

a camshaft that extends into the internal chamber of the lift block and includes an external cam surface, the camshaft arranged to receive a rotational input; and one or more cam followers disposed, in a radial direction, between the internal cam surface of the lift block and the external cam surface of the camshaft, the one or more cam followers arranged to move radially with respect to the camshaft.

13. The reciprocating assembly of claim 12, wherein the lift block, the camshaft, and the one or more cam followers are housed within a manifold.

14. The reciprocating assembly of claim 13, further comprising a cam guide that surrounds the cam followers in the axial direction to prevent movement of the cam followers in the axial direction relative to the manifold.

15. The reciprocating assembly of claim 12, wherein the lift block includes one or more holes arranged to permit fluid flow between the internal chamber and an external surface of the lift block.

16. The reciprocating assembly of claim 12, wherein a cross-sectional profile of the external cam surface of the camshaft is an oval.

17. The reciprocating assembly of claim 12, wherein the internal cam surface of the lift block is curved.

18. The reciprocating assembly of claim 12, wherein the internal cam surface of the lift block is linearly tapered.

19. A method of providing axial pump action with a pump assembly housed within a manifold, the method comprising:

providing a rotational input to a camshaft having an external cam surface;

radially translating one or more cam followers relative to the camshaft by moving the one or more cam followers along the external cam surface; and axially translating a lift block to provide axial pump action by moving the one or more cam followers along an internal cam surface of the lift block, the internal cam surface formed by an internal chamber of the lift block that varies in internal diameter in an axial direction.

20. The method of claim 19, further comprising:

translating axial movement of the lift block to a piston via a spring, wherein the piston provides the axial pump action.

* * * * *